United States Patent [19]

De Langis et al.

[11] 4,191,332

[45] Mar. 4, 1980

[54] SHOWER HEAD FLOW CONTROL DEVICE

[76] Inventors: David J. De Langis; Philip A. De Langis, both of 4060 W. 226th St., Torrance, Calif. 90505

[21] Appl. No.: 868,424

[22] Filed: Jan. 10, 1978

[51] Int. Cl.[2] ..... B05B 7/06

[52] U.S. Cl. ..... 239/428.5; 239/574 A; 239/586

[58] Field of Search ..... 239/460, 562, 586, 574, 239/428.5

[56] References Cited

U.S. PATENT DOCUMENTS

| | | | |
|---|---|---|---|
| 1,222,726 | 4/1917 | Brickell | 239/562 X |
| 2,448,792 | 9/1948 | Fraser | 239/460 |
| 2,688,515 | 9/1954 | Filliung | 239/460 X |
| 3,042,312 | 7/1962 | Packard | 239/586 X |
| 3,322,352 | 5/1967 | Alcantara | 239/428.5 |

FOREIGN PATENT DOCUMENTS

| | | | |
|---|---|---|---|
| 830673 | 3/1960 | United Kingdom | 235/428.5 |

*Primary Examiner*—John J. Love
*Attorney, Agent, or Firm*—Herman L. Gordon

[57] ABSTRACT

A flow control device for connection between a shower head and its supply pipe. The device consists of a fitting with one end attachable to the supply pipe and the other end attachable to the shower head. The fitting has a transversely slidable cylindrical valve element projecting on opposite sides of the fitting and provided with enlarged push buttons on its ends. The valve element has a peripheral groove which can be adjusted as to position in the bore of the fitting to give a desired rate of flow, or which can be moved away from the main bore to cause the valve element to shut off the flow, without requiring operation of the associated hot and cold water supply faucets. An air inlet passage is provided at the outlet side of the fitting to allow air to be aspirated into the water stream by venturi action, enabling the air to be mixed with the water in the spray head to thereby provide a regulated amount of aerated water in the shower head discharge.

4 Claims, 5 Drawing Figures

SHOWER HEAD FLOW CONTROL DEVICE

FIELD OF THE INVENTION

This invention relates to bathroom shower head attachments, and more particularly to a flow control device adapted to be connected between a shower head and its water supply pipe.

BACKGROUND OF THE INVENTION

In using bathroom shower equipment presently available, it is usually not possible to temporarily shut off the shower, for example, for applying soap to the user's body, without closing the associated hot and cold water supply faucets. This destroys the relative settings of the faucets previously established to obtain a desired mixed supply temperature of the water discharged from the shower head. In order to reestablish these settings when the shower is again turned on the faucets have to be readjusted to provide the desired water output temperature, in which process substantial time is consumed, causing discomfort to the wet user, and wherein a considerable amount of water is wasted during the attempt to reestablish the desired temperature. Also, the currently available spray adjusting devices used in shower heads are relatively difficult to operate, are structurally complicated, and do not provide a satisfactory range of adjustment.

SUMMARY OF THE INVENTION

Accordingly, a main object of the invention is to provide a novel and improved bathroom shower flow control device which overcomes the deficiencies and disadvantages of the prior art shower head flow control devices.

A further object of the invention is to provide an improved shower head flow control device which is easy to install, which is very simple in construction, and which can be conveniently employed by a user to serve as a temporary on-off valve for water flow without destroying a previously adjusted setting of the associated hot and cold water supply faucets.

A still further object of the invention is to provide an improved shower head flow control device which conveniently allows a person to temporarily shut off the flow of water to the shower head while he is applying soap to his body and to thereafter restore flow at substantially the same adjusted tmeperature as was previously obtained, and which allows a wide range of spray adjustments, including the mixing of air with the water to provide a flow which includes particles of water mixed with air.

A still further object of the invention is to provide an improved shower head flow control device which allows temporary stoppage of water flow without requiring readjustment of hot and cold water supply faucets, and which thereby avoids the necessity of manipulating said faucets to reestablish a desired mixed water temperature, and which consequently reduces water wastage, as well as time consumed in taking a shower.

A still further object of the invention is to provide an improved shower head flow control device which can be conveniently and efficiently employed by a user to accurately adjust the strength of the water spray emitted from the shower head, the adjustment being easy to make, and being able to be performed by the user while he is actually standing under the shower.

A still further object of the invention is to provide an improved shower head flow control device which can be employed to restrict, aerate, and accurately control water flow, which makes it possible to deliver a reduced flow with maximum force, which permits temporary shut-off of water without operating the hot and cold water supply faucets, which can be quickly and easily installed between a shower head and associated water pipe, which can be designed for all standard shower heads and pipe, which acts to reduce water wastage and the costs involved in heating the water, and which enables a user to utilize set faucet positions for obtaining the same water temperature for every shower.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
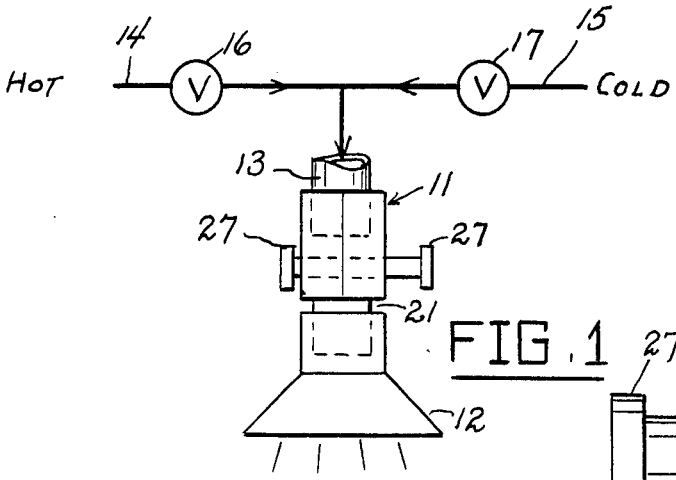
FIG. 1 is a diagrammatic elevational view of a bathroom shower system employing an improved shower flow control device according to the present invention.
Figure 3:
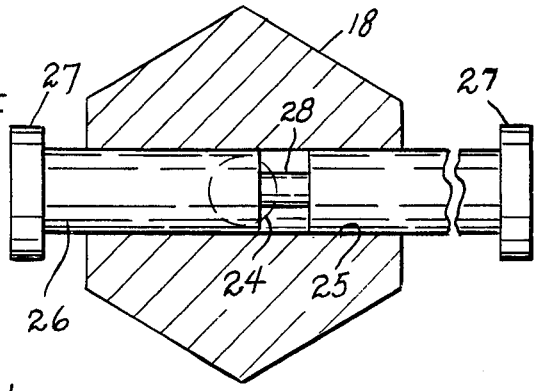
FIG. 3 is a horizontal cross-sectional view taken substantially on the line 3—3 of FIG. 2.

Referring to the drawings, 11 generally designates a shower head flow control device according to the present invention, which may be connected between a conventional shower head 12 and a water supply pipe 13, as shown in FIG. 1. The supply pipe 13 carries a mixture of hot and cold water from respective hot and cold water supply pipes 14 and 15 provided with respective faucet valves 16 and 17 which can be manually adjusted to provide a desired water temperature in the shower head 12.

The flow control device 11 comprises a main body or fitting 18 having a suitably shaped external contour, for example, having a hexagonal shape, the fitting 18 being provided with an internally threaded upper end portion 19 adapted to threadedly receive the end of a water supply pipe 13 and having an externally threaded reduced lower end portion 20 adapted to be threadedly engaged with and be connected to a standard shower head 12. The externally threaded lower end portion 20 is preferably of sufficient length to allow for a clearance space 21 between the upper rim 22 of the shower head and the adjacent shoulder 23. Thus, said length may be such as to provide this clearance space 21 when the shower head 12 is tightly engaged on the lower fitting end portion 20.

The fitting 18 has an axial main bore 24 and an intersecting transverse bore 25 whose diameter is at least equal to and is preferably somewhat larger than that of said main bore 24. Slidably mounted in the transverse bore 25 is a valve rod element 26 provided on its opposite ends with enlarged push button members 27,27. The bore 25 may be of circular cross-section, in which case the valve element 26 is likewise of circular cross-section. Alternatively, the bore 25 and valve element 26 may be of any other desired cross-sectional shape.

Figure 5:
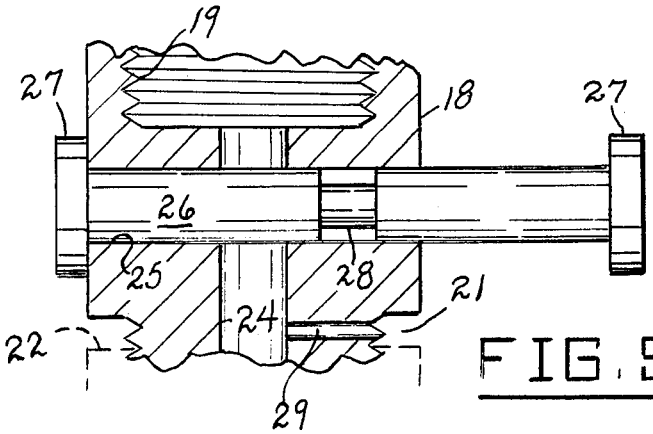
FIG. 5 is a fragmentary vertical cross-sectional view similar to FIG. 2 but showing the slidable valve element in a water shut-off position.

Valve element 26 is provided at an intermediate location thereon which a peripheral groove 28 of an axial length of the same order as and preferably slightly less than the diameter of main bore 24. The location of groove 28 is such that it can be positioned either in full or adjusted partial registry with main bore 24, for example, in the position shown in FIG. 2, or in a blanked or cut-off position, such as that shown in FIG. 5, wherein bore 24 is completely blocked. This may be accomplished by exerting appropriate manual force on the push buttons 27,27. For example, element 26 may be placed in a blocking position when one of the buttons 27 is pushed to a position engaging the adjacent side surface of fitting 18, as shown in FIG. 5. Bore 18 may be unblocked by exerting inward pushing force on the opposite button 27 to cause the groove 28 to be moved to a desired degree of registry with main bore 24, thus regulating the flow to the shower head 12.

Figure 2:
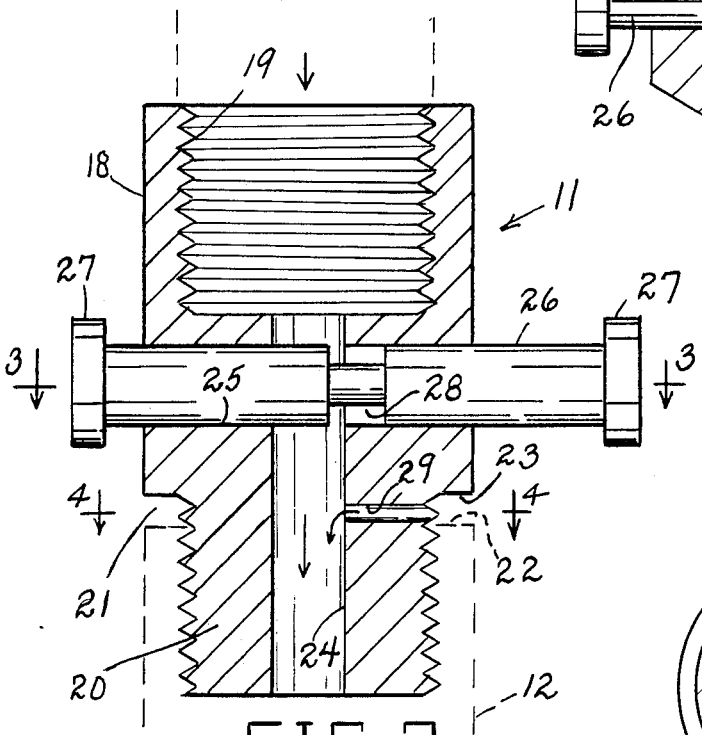
FIG. 2 is an enlarged vertical cross-sectional view taken through the flow control device used in the system of FIG. 1.

The reduced outlet fitting portion 20 is provided with a small air passage 29 located immediately subjacent the shoulder 23 and being in communication with the clearance space 21, as shown in FIG. 2. This defines a venturi passage to allow air to be aspirated into the water stream passing into the shower head, causing the air to mix with the water. The flow of water may be regulated, by suitably restrictive positioning of the groove 28, so that a substantial amount of air becomes entrained with the high-velocity water stream produced by restrictive positioning of groove 28. This provides a highly aerated spray at the shower head 12. The pressure differential producing the aspirating effect may be adjusted in accordance with the restrictive positioning of the groove 28, and thus the aspirated air input will depend on said positioning. In general, the higher the water stream velocity is, the greater will be the percentage of air in the aerated shower spray.

Thus, it has been found that a strong and highly satisfactory shower spray can be obtained with the flow control valve element 26 just short of a closed position.

Since the air inlet orifice 29 is located relatively close to the shower head, namely, close to where the high-velocity water stream is released to the atmosphere, the back pressure developed in the shower head can be easily overcome by suitably adjusting the restrictive position of groove 28 to provide required velocity of the water stream.

The required positioning of valve element 26 to obtain a desired type of shower spray can be accomplished easily by the user after a small amount of practice. This is facilitated by the fact that the user can easily simultaneously grasp the opposite end buttons 27,27 between the fingers of one hand, while standing under the shower head.

Figure 4:
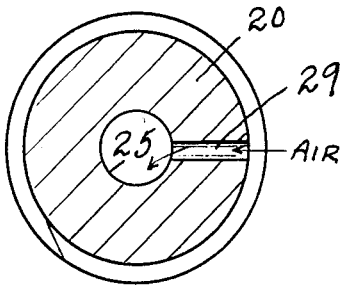
FIG. 4 is a horizontal cross-sectional view taken substantially on the line 4—4 of FIG. 2.

The air inlet passage 29 may be readily oriented, as shown in FIGS. 2 and 4, or may be otherwise suitably oriented. A plurality of spaced air inlet passages communicating with the space 21 may be provided in the wall of reduced fitting end portion 20, if so desired.

The valve element 26 may have a slightly loose fit in the bore 25 to purposely cause a perceptible amount of leakage. Thus, this allows a person to substantially shut off the water while applying soap to his body, but after the showering is finished, requires the person to close the hot and cold water faucet valves 16 and 17 to prevent water wastage and to avoid a cross-connection between the hot and cold water pipes 14 and 15.

In operation, with faucet valves 16 and 17 set to relative positions to obtain the desired water temperature, the user adjusts valve element 26, by means of the push buttons 27, to obtain the desired type of shower spray. The user may temporarily shut off the shower while applying soap to his body, by moving the valve element 26 to a closed position, for example, as shown in FIG. 5. After soaping, the user may resume showering by moving valve element 26 to a suitable flow-restricting position to give the desired type of rinsing spray, which may be adjusted, for example, to comprise a substantially aerated spray, or, if so desired, to comprise substantially full water flow.

When the valve element 26 is employed in a highly restrictive position, the water flow velocity through the restriction will be high, and substantial aeration will occur. As above mentioned, a highly satisfactory shower can be obtained under these conditions, with a relatively small amount of water consumption. Thus, by employing the variable throat adjustment afforded by the transversely movable valve element 26 it is possible to obtain satisfactory showering at a desired water temperature, with minimum water consumption and with minimum wastage of water. When the required relative settings of faucet valves 16 and 17 are known, it is possible to set these faucet valves to said positions, with valve element 26 in fully closed position, and then proceed to take a shower by moving said valve element 26 to a desired spray position.

As a modification, the valve employed in the device could be of a rotary type instead of sliding. Also, the device may be used in any application where aeration and shut off is desired, such as on a garden hose.

While a specific embodiment of an improved shower head control device has been disclosed in the foregoing description, it will be understood that various modifications within the spirit of the invention may occur to those skilled in the art. Therefore it is intended that no limitations be placed on the inventions except as defined by the scope of the appended claims.

What is claimed is:

1. A shower system comprising respective hot and cold water supply conduits including manually adjustable control valves, a common water supply pipe connected to said supply conduits, whereby water may be supplied to said supply pipe at a mixture temperature in accordance with the relative settings of said control valves, a shower head, a conduit fitting connected between said common supply pipe and said shower head, said fitting having a straight longitudinal bore extending between its opposite ends, an elongated valve element slidably engaged transversely in said fitting and intersecting said bore, at least one end of said valve element projecting laterally from said fitting, said valve element being formed with an annular peripheral groove having an axial length slightly less than the diameter of said longitudinal bore, registrable at times with said longitudinal bore and being movable to selected flow-restricting positions to adjustably control the velocity of liquid flow through the fitting to the shower head and being movable at other times to a flow-blocking position relative to said bore, wherein said fitting has a reduced externally threaded lower end portion defining a peripheral shoulder, said externally threaded lower end portion being tightly threadedly engaged with the shower head and having a length providing an annular clearance space between the shower head and said peripheral shoulder, and wherein the wall of said reduced lower end portion adjacent to said shoulder is formed with a small air-aspirating passage communicating with said clearance space, whereby said clearance space and air-aspirating passage define a venturi passage to allow air to be aspirated into the water stream passing into the shower head, causing the air to mix with the water, the air-aspirating passage being located relatively close to the shower head, whereby the back pressure developed in the shower head can be readily overcome by suitably adjusting the restrictive position of the groove to provide the required velocity of the water stream.

2. The shower system of claim 1, and wherein said valve element is provided at least at one end with an enlarged button member projecting laterally from said fitting.

3. The shower system of claim 1, and wherein said valve element projects laterally from said fitting and is provided at its opposite ends with enlarged push button members.

4. The shower system of claim 1, and wherein the top end of the fitting is provided with internal threads for threaded connection to said water supply pipe.

* * * * *